US005537899A

United States Patent [19]

Diedrich

[11] Patent Number: 5,537,899

[45] Date of Patent: Jul. 23, 1996

[54] DUAL-PAWL RATCHETING MECHANISM WITH PROVISION FOR PREVENTING PAWL JAMMING

[75] Inventor: Thomas J. Diedrich, Racine, Wis.

[73] Assignee: Snap-On Technologies, Inc., Crystal Lake, Ill.

[21] Appl. No.: 409,036

[22] Filed: Mar. 27, 1995

[51] Int. Cl.[6] ..... B25B 13/46

[52] U.S. Cl. ..... 81/57.39; 81/62; 192/43.1

[58] Field of Search ..... 81/57.39, 62, 63.1; 192/43.1

[56] References Cited

U.S. PATENT DOCUMENTS

| | | |
|---|---|---|
| 2,395,681 | 2/1946 | Odlum et al. . |
| 2,544,795 | 3/1951 | Knudsen . |
| 2,565,961 | 8/1951 | Godfrey . |
| 2,772,763 | 12/1956 | Johnson . |
| 3,290,969 | 12/1966 | Bergquist et al. . |
| 3,467,231 | 9/1969 | Haznar . |
| 3,532,013 | 10/1970 | Haznar . |
| 4,497,227 | 2/1985 | Stasiek . |
| 4,588,060 | 5/1986 | Norton . |
| 4,765,449 | 8/1988 | Peters . |
| 4,807,500 | 2/1989 | Main . |

*Primary Examiner*—James G. Smith
*Attorney, Agent, or Firm*—Emrich & Dithmar

[57] ABSTRACT

A ratcheting assembly around which is coaxially coupled a ratchet head of the type having internal teeth, the latter imparting rotational movement to the ratcheting assembly. The ratchet assembly includes a drive body having recessed grooves for receiving pivotably mounted first and second elongated pawls. Each pawl includes teeth on opposite ends thereof for engagement with the teeth on the ratchet head. A reversing knob assembly is coupled to the drive body and includes a reversing knob and pins for pivotally rotating said pawls between first and second conditions. Pawl positioning pins coupled to the drive body operate to maintain the pawls with their longitudinal axes substantially parallel to each other so as to prevent them from jamming relative to the teeth on the ratchet head.

17 Claims, 2 Drawing Sheets

DUAL-PAWL RATCHETING MECHANISM WITH PROVISION FOR PREVENTING PAWL JAMMING

BACKGROUND OF THE INVENTION

1. Field of the Invention

The present invention relates generally to ratchet wrenches, and relates more specifically to a self-contained ratcheting mechanism with a reversing knob and dual pawls.

2. Description of the Prior Art

Dual-pawl reversible ratchet wrenches are well known in the art. Typically, such ratchet wrenches include a self-contained ratcheting mechanism having a reversing knob securely retained to a ratcheting assembly. The reversing knob is coupled to pivotally mounted left and right pawls with teeth on their outer ends. The pawls are mounted to engage ratchet teeth formed on the inner surface of a bore in the ratchet head into which the self-contained ratcheting mechanism is received. Rotational movement of the reversing knob to one position urges one end of one pawl and the opposite end of the other pawl into engagement with the teeth of the ratchet head. The purpose of these pawls, and pawls in general, being to prevent rotation in one direction while allowing rotation in the opposite direction. Upon actuation of the reversing knob to the opposite position, the pawls are pivoted causing the engaged teeth on the pawls to become disengaged and the respective other ends thereof to be urged against the teeth of the ratchet head.

A conventional type dual-pawl ratchet wrench with a self-contained ratcheting mechanism is described in U.S. Pat. No. 4,765,449 to Peters. The pawls in such a construction move in tandem as they pivot. They are generally elongated and their longitudinal axes are supposed to be maintained substantially parallel. The construction of dual-pawl ratchets is such that, under high loading and/or wear, one pawl could oppose the other, causing the mechanism to jam. In the jammed condition, illustrated in prior art FIG. 1, the pawls 1, 2 move to a pigeon-toe-like position with their longitudinal axes intersecting so that the same ends of both pawls are engaged, thus opposing rotation in the opposite directions, and the ratchet may not be operated in either direction. It should be understood that the jammed condition shown in FIG. 1 cannot occur in single-pawl ratchet assemblies.

In conventional dual-pawl ratchets, a selector knob cooperates with plungers and springs for operation of the ratchet between the forward and reverse directions, all in a well known manner. Occasionally, a reversing movement of the selector knob reverses only one of the pawls, resulting in the pigeon-toe position described above, causing the ratchet to become jammed or locked-up, as described below.

Pawl jamming (pigeon-toeing) of dual-pawl ratchets may occur under a number of differing situations and is generally facilitated by heavy loading, component distortion or component wear. Jamming generally occurs when one pawl becomes disengaged in response to a reversing movement of the selector knob, while the other pawl—usually a pawl under an applied or residual loading force to the ratchet head—remains engaged. Thus, the disengaged pawl moves into a reversed or opposing condition relative to the other pawl such that the pawls are in the pigeon-toe position and the ratchet mechanism is said to be jammed.

It is a well known phenomenon that the unique geometry and relative positions of the pawls of dual-pawl assemblies causes one pawl to bear a force greater than the opposite pawl during a loading situation. As a result, if the ratchet tool user attempts to manually turn the selector knob, in an effort to reverse the dual-pawl ratchet assembly, while continuing to apply a loading force on the ratchet head, the pivoting force on the selector knob may not be great enough to overcome the loading force on the more heavily loaded pawl. Thus, only one pawl will reverse, resulting in the jammed condition.

The same jamming condition can also result during a sudden acceleration of the ratchet, as during the sudden release which may occur during loosening of a stuck fastener. This acceleration generates an inertial force of sufficient magnitude to cause the selector knob assembly to self-rotate. This could cause the engaged pawl, i.e., the pawl imparting the bulk of the loosening load, to remain engaged while the opposite pawl pivots to its opposite position in pigeon-toe relation to the engaged pawl, causing the ratchet to become jammed.

Air driven ratchet tools impart a loading torque in a given direction (tightening or loosening directions) by rapidly oscillating between a loading and ratcheting conditions during a torquing operation. The vibration associated with this oscillation could result in a reversal of only one pawl, resulting in the jammed condition.

It is further possible that a lockup (pigeon-toeing) of the pawls could occur during ratcheting (non-load mode), possibly due to the high speed oscillation phenomenon of the pawls as they ride over the ratchet head teeth, causing one (or both) of the pawls to flip to an opposing condition, aided by its rotational inertia, and jamming the ratchet.

Thus, there is a need to provide a ratchet wrench with a mechanism that would prevent the pawls from jamming in this manner but which is easy and economical to assemble and manufacture.

SUMMARY OF THE INVENTION

It is a general object of the present invention to provide a dual-pawl ratcheting assembly for use with a hand-held wrench or the like which is economical and easy to manufacture.

It is another object of the present invention to make the ratcheting assembly self-contained and usable with any number of different ratchet heads of the type having internal teeth, thus providing application of the ratcheting assembly with a variety of different handles, including air driven tool handles and the like.

It is another object of the present invention to provide a dual-pawl ratcheting assembly with a structure which prevents jamming of the pawls relative to the ratchet head.

These and other features of the present invention are attained by providing a ratcheting assembly around which is coaxially coupled a ratchet head of the type having internal teeth, the latter imparting a rotational force to the ratcheting assembly. The ratcheting assembly includes a drive body having recessed grooves for receiving pivotally mounted first and second pawls. Each pawl includes teeth on opposite ends thereof for engagement with the teeth on the ratchet head. A selector knob assembly is coupled to the drive body and includes a reversing knob and pins for shifting said pawls between a first condition and a second condition. Pawl positioning pins coupled to the drive body operate to maintain the pawls substantially parallel to each other so as to prevent them from jamming relative to the teeth on the ratchet head.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 2:
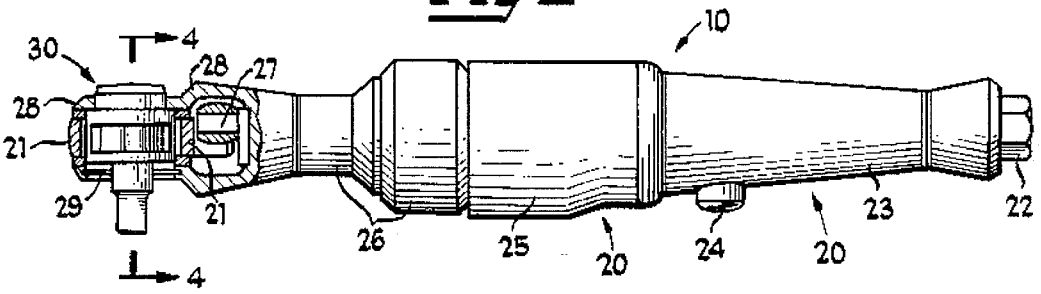
FIG. 2 is a side elevational view in partial section of the self-contained ratcheting assembly of the present invention shown connected to a ratchet head coupled to an air driven tool handle.

Referring to FIG. 2, there is illustrated a reversible ratchet wrench 10 including a handle 20 coupled by way of a ratchet head 21 to a ratcheting assembly 30. The handle 20 is of the type conventionally associated with air driven ratchet tools and includes an inlet bushing 22 for coupling an external air hose, a frustoconically-shaped handle portion 23 provided with a trigger button 24, a main body portion 25 extending forward of the handle portion 23 and housing an air motor assembly (not shown), and a forward portion 26 housing an internal gear/shaft subassembly, part of which is illustrated at 27, integrally coupled to the air-motor assembly coupling to the ratchet head 21 within ratchet housing portion 28. The ratchet housing portion 28 contains ratchet head 21 in a slot therein. The ratchet head 21, in turn, is coaxially coupled around ratcheting assembly 30, and the whole retained integrally by the housing portion 28 and by a retaining assembly 29, all in a known manner.

Figure 3:
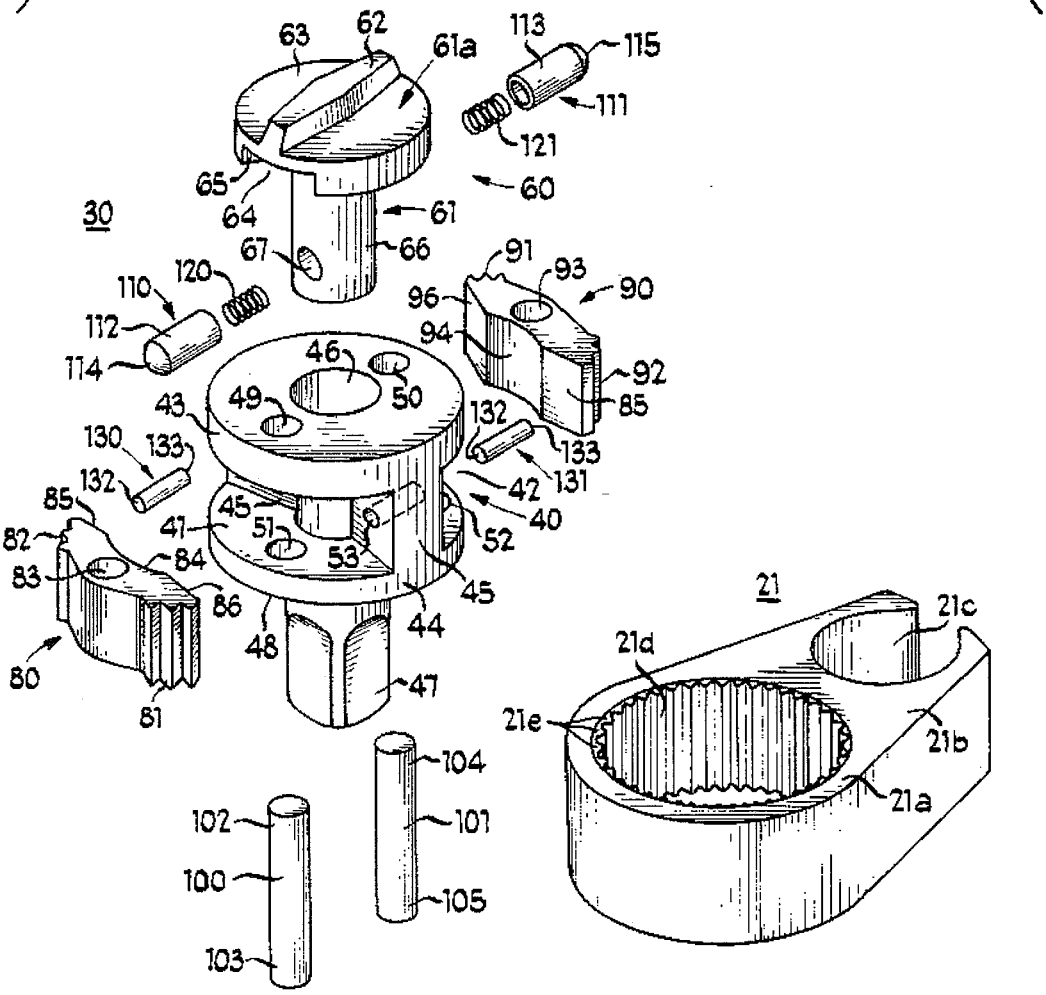
FIG. 3 is an enlarged, exploded, perspective view of the self-contained ratcheting assembly and ratchet head of FIG. 2.

The ratcheting assembly 30 of the present invention is of multi-part construction and is shown in greater detail in FIG. 3, along with the ratchet head 21. Ratcheting assembly 30 includes a drive body 40, a reversing assembly 60, left and right pawls 80, 90 and associated pawl pivot pins 100, 101. The reversing assembly 60 includes a selector knob 61, left and right plungers 110, 111 and associated plunger springs 120, 121, and pawl-end positioning pins 130, 131.

Ratchet head 21 is of unitary construction consisting of a generally cylindrical front end portion 21*a* from which extends a stem portion 21*b* having a fixed diameter through-bore 21*c* with a portion of its surface partially open to receive therein the portion 27 of the gear/shaft subassembly. In the front end portion 21*a* is formed a second through-bore 21*d* with internal teeth 21*e* extending parallel to the axis of the bore 21*d* around the entire circumference of the bore 21*d*. The ratchet head 21 imparts rotational movement to the ratcheting assembly 30 and accommodates ratcheting movement relative thereto in a well-known manner. It will be appreciated that the construction of the ratchet head 21 is significantly dependent on the type of handle, i.e., air driver tool handle or the like, with which the ratcheting assembly 30 of the present invention will be utilized.

Figure 4:
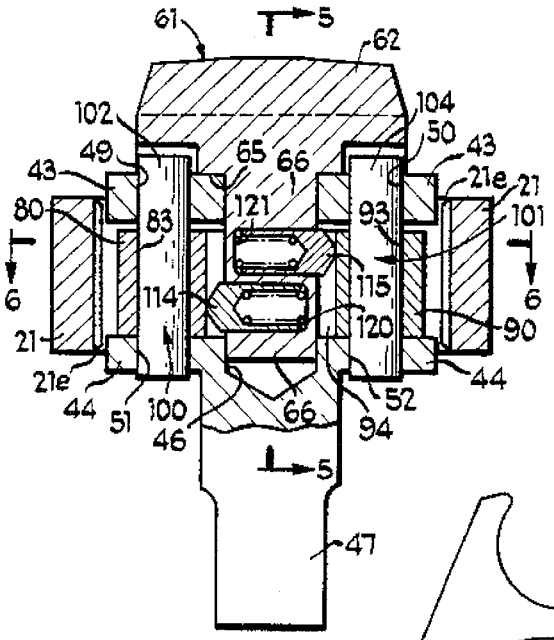
FIG. 4 an enlarged, vertical sectional view of the self-contained ratcheting assembly removed from the tool handle and taken generally along the line 4—4 of FIG. 2.
Figure 5:
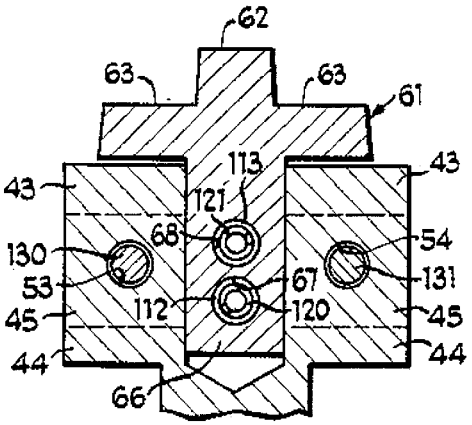
FIG. 5 is a fragmentary, vertical sectional view of the self-contained ratcheting assembly taken generally along the line 5—5 of FIG. 4.
Figure 1:
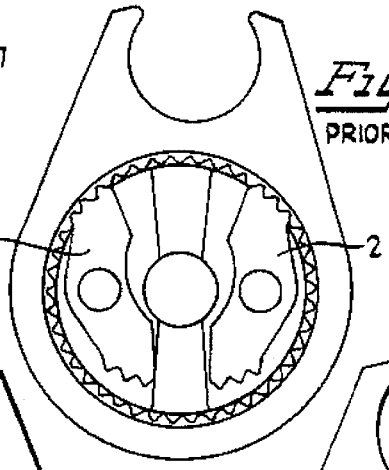
Fig 1 PRIOR ART
FIG. 1 is a horizontal sectional view of a prior art dual-pawl ratcheting assembly showing the position of the pawls in a pigeon-toe (lockup) condition.

Referring also to FIGS. 4 and 5, the drive body 40 is generally cylindrical and has a pair of opposing recesses 41, 42 which divide the drive body into an upper portion 43 and a lower portion 44 connected by vertical posts 45. The drive body 40 includes a generally cylindrical central bore 46 formed axially through the upper portion 43 and extending partially down into a square drive member 47 extending axially from a bottom surface 48 of lower portion 44. A pair of smaller diameter bores 49, 50 are formed parallel to the central bore 46 through the upper portion 43 of drive body 40 at diametrically opposed locations thereon. A pair of corresponding bores 51, 52, respectively coaxial with bores 49, 50, are formed through the lower portion 44. Another pair of bores 53, 54 are formed respectively through the vertical posts 45 and are dimensioned to respectively slidably receive associated pawl-end positioning pins 130, 131. Preferably, the axes of the bores 53, 54 lie in a common plane perpendicular to the axis of the drive body 40.

The selector knob 61 is also of unitary construction and consists of a cylindrical head portion 61*a* having a raised wall 62 on a top surface 63 thereof to facilitate angular rotation of the selector knob 61 by a user's fingers. A pair of pin receiving slots 64 of fixed depth are formed in the bottom surface 65 of head portion 61*a* at diametrically opposed locations. A central cylindrical shaft 66 dimensioned to be received within the central bore 46 of drive body 40 extends axially from the center of bottom surface 65 of selector knob 61. A pair of holes 67, 68 extend transversely a fixed distance into cylindrical shaft 66 (see FIG. 5) at locations which are axially spaced and diametrically opposed. The holes 67, 68 are respectively dimensioned to receive left and right plungers 110, 111 and associated plunger springs 120, 121.

Left and right elongated pawls 80, 90 have respective sets of teeth 81, 82 and 91, 92 formed in opposing ends thereof, the pawls 80, 90 being respectively received within the recesses 41, 42, and respectively have holes 83, 93 formed therethrough midway between the opposed ends thereof. Bores 49–52, 83, and 93 are all of like diameter and are aligned for receiving associated pawl pivot pins 100, 101 therethrough. The pawls 80, 90 respectively have arcuate central inner surfaces 84, 94, and flat planar end inner surfaces 85, 86 and 95, 96, respectively. Left and right pawl pivot pins 100, 101 are cylindrical in shape and have ends 102, 103 and 104, 105, respectively.

Left and right plungers 110, 111 comprise partly hollow cylindrical bodies 112, 113 dimensioned to respectively receive the plunger springs 120, 121, which are helical compression springs. The outer ends of the plungers 110, 111 have generally rounded surfaces 114, 115 to facilitate a camming action by the plungers 110, 111 against the central inner surfaces 84, 94 of pivoting pawls 80, 90, as will be described below.

Pawl-end positioning pins 130, 131 are also generally cylindrical and defined by rounded end surfaces 132, 133, respectively.

All the components of ratcheting assembly 30 are preferably constructed from suitable metals, but it will be appreciated that other materials could be used for certain parts.

The initial assembly of the components of the ratcheting assembly 30 will now be described in conjunction with FIGS. 4–6. It will be appreciated that the ratchet head 21 is initially mounted in the housing portion 28 of the handle 20. First, the shaft 66 of selector knob 61 is slidably inserted in the central bore 46, the bottom surface 65 of knob 61 resting on the outer surface of upper portion 43 of drive body 40. The selector knob 61 is then rotated as necessary until the holes 67, 68 are visually aligned on opposite sides thereof between vertical posts 45 of drive body 40 so as to communicate with opposing recesses 41, 42, respectively. It will be appreciated that, since the ratcheting assembly 30 is generally symmetrical about the rotational axis, holes 67, 68 may instead also be aligned to alternatively communicate with recesses 42, 41, respectively.

Once shaft 66 is so aligned, pawl-end positioning pins 130, 131 are slidably inserted into associated bores 53, 54 on vertical posts 45, with corresponding rounded edge surfaces 132, 133 protruding outwardly therefrom. Resilient plunger springs 120, 121 are inserted within the associated partly hollow cylindrical bodies 112, 113 of plungers 110, 111 and the latter are then positioned carefully within the associated holes 67, 68 on the shaft 66 so as to resiliently protrude outwardly therefrom.

The left and right pawls 80, 90 are then moved into their respective positions within opposed recesses 41, 42 of drive body 40, bringing into alignment the holes 83 and 93 of pawls 80, 90 with coaxial bores 49, 51 and 50, 52, respectively. Finally, to retain the pawls 80, 90 in position within recesses 41, 42, associated pawl pins 100, 101 are fit upwardly through the aligned bores 51, 83, 49 and 52, 93, 50, respectively, until ends 102, 104 of pawl pins 100, 101 protrude upwardly from drive body 40 into associated ones of pin-receiving slots 64 in selector knob 61.

Figure 6:
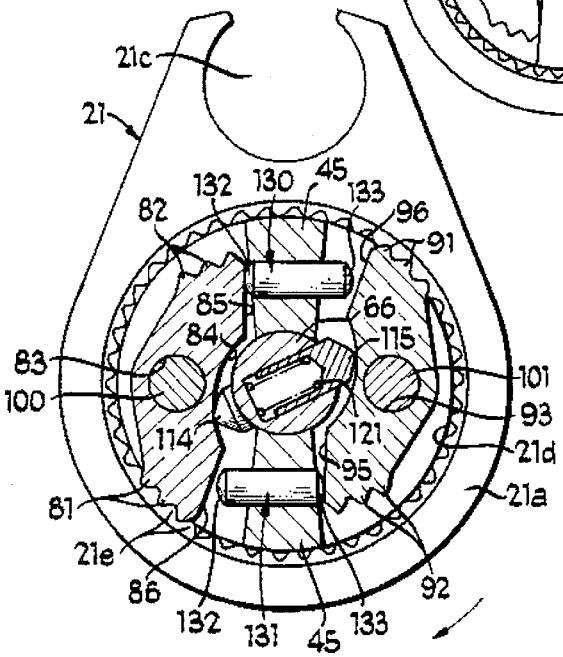
FIG. 6 is a horizontal sectional view of the self-contained ratcheting assembly taken generally along the lines 6—6 of FIG. 4 and rotated slightly counterclockwise therefrom, and showing the position of the pawls in a condition preventing rotation of the ratcheting assembly relative to the ratchet head in one direction and ratcheting in the opposite direction.
Figure 7:
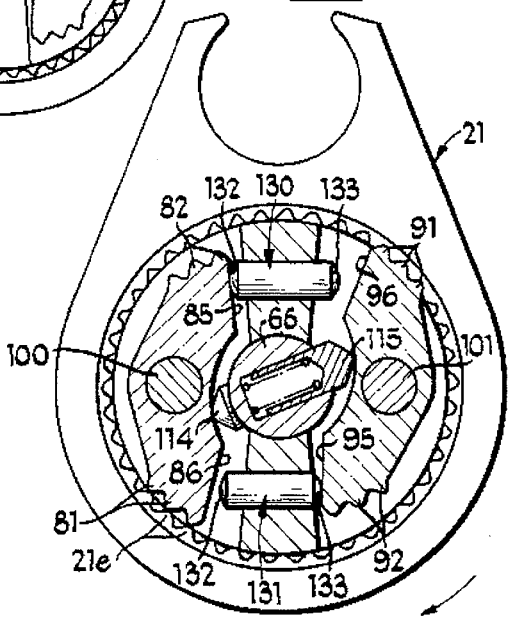
FIG. 7 is a view similar to that of FIG. 6 but showing the position of one pawl urging an opposite end of a pawl-end positioning pin against the end wall of an opposed pawl so as to prevent the opposed pawl from moving to a jammed condition.

Once all the ratcheting assembly 30 components are assembled as described, the ratchet head 21 is coaxially coupled around the drive body 40 urging opposed ones of teeth 81 and 91 on pawls 80, 90 to mesh against the teeth **21*e* on the ratchet head 21, as shown more clearly in FIG. 6. In this position, the ratchet head 21 is disposed in a ratcheting relationship with the ratcheting assembly 30, as will be further described below. Finally, the retaining assembly 29 is mounted on the housing portion 28 to retain the ratcheting assembly 30** in place in a conventional manner.

FIG. 6 shows those of pawl teeth 81, 91 disposed adjacent corresponding flat end surfaces 86, 96 engaged with the teeth **21*e* of the ratchet head 21. It should be understood, however, that the ratcheting assembly 30 of the present invention is selectably reversible and therefore initially the pawls 80, 90 could just as easily have been tilted the opposite direction such that those pawl teeth 82, 92 closest to flat end surfaces 85, 95 would have been initially engaged with teeth 21*e* instead. The reversible operation of ratcheting assembly 30 will be made clear from the foregoing discussion of FIGS. 4–7** and is well-known to those skilled in the art.

Given the position of the pawls 80, 90 shown in FIG. 6, a torque imparted clockwise (direction of arrow) will cause pawls 80, 90 to engage teeth **21*e*. Any rotational movement of the ratchet head 21 in the clockwise direction will therefore be imparted from the teeth 21*e* of ratchet head 21 to the drive body 40 causing the drive body 40** to rotate therewith, thereby to impart a rotational force to an associated part, such as a socket, connected thereto.

When the ratchet head 21 is rotated in the opposite (or counterclockwise) direction with the pawls 80, 90 in the same initial position, ratcheting will occur instead. Because the pawls 80, 90 are pivotally mounted, pivoting occurs about the associated pawl pins 100, 101 when a tangential force is applied thereto. Hence, when the ratchet head 21 is rotated opposite the direction of the arrow, the teeth **21*e* of the ratchet head 21 will urge corresponding ones of the pawl teeth 81, 91 to ride the cammed surfaces of teeth 21*e* ultimately to be pushed away causing the pawls 80, 90 to pivot in the direction of rotation against the urging of the springs 120, 121 just enough to allow the respective ratchet head teeth 21*e* to slide past the overlying pawl teeth 81, 91**, resulting in a ratcheting effect.

It is a fundamental aspect of the invention that reversal of only one pawl is effectively prevented, thereby preventing a jammed condition. Thus, in the event one of the pawls 80 becomes disengaged from teeth **21*e* on ratchet head 21, such as may occur during a reversing movement of the selector knob 61 (either intentional or inadvertently) if the other pawl 90 remains engaged it will cooperate with positioning pin 131 to prevent the disengaged pawl 80 from flipping to its opposing position. As the disengaged pawl 80 pivots, causing its flat end surface 86 to make contact with the rounded end surface 132 of pawl-end positioning pin 131, the positioning pin 131 will slide laterally through bore 53 until its opposite rounded surface 133 is brought into contact with the flat end surface 95 of engaged pawl 90. Assuming the inertia of the pivoting (disengaged) pawl 80 is not great enough to overcome the moment force of the engaged pawl 90 on the positioning pin 131, the positioning pin 131 will function as a stopper preventing the further pivoting of the disengaged pawl 80 and thus preventing a lockup condition and the pigeon-toeing of the pawls 80, 90** relative to one another.

Similarly, if pawl 90 were to initially become disengaged instead (not shown), the flat end surface 85 of the engaged pawl 80 would cooperate with pawl-end positioning pin 130 to prevent the disengaged pawl 90 from pivoting to the opposing or pigeon-toed position.

It should be understood that the ratcheting assembly 30 is reversible, thus permitting ratcheting in forward and reverse directions. It should be readily apparent that, when the positions of the pawls are reversed, pawl teeth 82, 92 located adjacent associated flat side walls 85, 95 will be urged to the engaged position with respect to the teeth **21*e* of ratchet head 21. By the same token, the pawl teeth 81, 91 on the respective opposite ends of pawls 80, 90 are decoupled from the ratchet head 21** making no contact therewith.

The function and operation of the pawl-end positioning pins 130, 131 therefore is to prevent only one of the pawls 80, 90 from pivoting to a condition opposite that selected by the reversing assembly 60. This is generally achieved by the pins 130, 131 maintaining a predetermined minimum spacing between adjacent ends of the pawls 80, 90, thus ensuring a substantially parallel positioning of pawls 80, 90 at all times.

It should be noted that the range of rotational movement of selector knob 61 is limited to the maximum angular distance that each of pawl pins 100, 101 can travel within their respective opposing pin receiving slots 64. It should be appreciated therefore that the cooperation of pawl pin ends 102, 103 within associated slots 64 of selector knob 61 facilitates selection of ratchet reversing action between a first condition (tightening in the clockwise direction, ratcheting in the opposite/loosening direction) and a second condition (ratcheting in the tightening direction and loosening or non-ratcheting in the opposite direction).

The use of pawl-end positioning pins 130, 131 in the manner described in the preferred constructional embodiment goes a long way to overcome the common problem of pawl pigeon-toeing associated with dual-pawl, reversible ratcheting assemblies. It is well known that dual-pawl ratcheting assemblies offer higher strength than single pawl mechanisms by means of shared loading. The present invention offers that higher strength while at the same time obviating the problem of permanent pigeon-toeing normally caused by one of the pawls becoming disengaged and flipping to an opposing direction. It should be understood, however, that the present invention does not prevent the occurrence of self-reversing, where both pawls become disengaged and together flip to the opposite position.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A reversible ratcheting assembly for coupling to a ratchet head of the type having ratchet teeth on an internal surface thereof, comprising:

a rotatable drive body having first and second pawls pivotally mounted thereon, each of said pawls including teeth on opposite ends thereof disposed for engagement with the teeth on the ratchet head;

a reversing assembly on said drive body and coupled to said pawls and selectively movable for shifting said pawls between forward and reverse ratcheting conditions; and pawl positioning means engageable with and disengageable from said pawls to prevent movement of one of said pawls to a condition opposite that selected by said reversing assembly, while the other one of said pawls remains engaged in the condition selected by said reversing assembly.

2. The ratcheting assembly of claim 1, wherein said pawls are pivotally mounted to said drive body by way of associated pivot pins extending therethrough parallel to an axis of rotation of said drive body.

3. The ratcheting assembly of claim 2, wherein said reversing assembly includes a knob having a pair of slots for respectively receiving associated ends of said pivot pins, said pivot pins being engageable with said knob for limiting the movement of said knob between said forward and reverse ratcheting conditions.

4. The ratcheting assembly of claim 3, wherein said reversing assembly includes a pair of plungers and associated compression springs coupled to said knob and respectively engageable with said pawls for pivoting said pawls in response to movement of said reversing knob between said forward and reverse ratcheting conditions.

5. The ratcheting assembly of claim 4, wherein said pawl positioning means includes at least one positioning pin for maintaining a predetermined minimum spacing between adjacent ends of said pawls.

6. The ratcheting assembly of claim 5, wherein said at least one positioning pin includes a pair of positioning pins disposed between said pawls respectively at the opposite ends thereof.

7. The ratcheting assembly of claim 6, wherein said positioning pins are carried by said drive body.

8. The ratcheting assembly of claim 7, wherein said positioning pins are slidably movable relative to said drive body in response to movement of said pawls.

9. The ratcheting assembly of claim 8, wherein the ratchet head is coupled to an air driven tool handle.

10. The ratcheting assembly of claim 1, wherein said reversing assembly includes a pair of plungers respectively engageable with said pawls for moving said pawls between said forward and reverse ratcheting conditions in response to movement of said reversing assembly.

11. A reversible ratcheting assembly for coupling to a ratchet head of the type having ratchet teeth on an internal surface thereof, comprising:

a rotatable drive body having first and second pawls pivotally mounted thereon, each of said pawls including teeth on opposite ends thereof disposed for engagement with the teeth on the ratchet head;

a reversing assembly on said drive body and coupled to said pawls and selectively movable for shifting said pawls between forward and reverse ratcheting conditions; and pawl positioning means engageable with and disengageable from said pawls to prevent either of said pawls from jamming relative to the teeth on the ratchet head.

12. The ratcheting assembly of claim 11, wherein said pawl positioning means includes at least one positioning pin for maintaining a predetermined minimum spacing between adjacent ends of said pawls.

13. The ratcheting assembly of claim 12, wherein said at least one positioning pin consists of a pair of positioning pins disposed between said pawls respectively at the opposite ends thereof.

14. The ratcheting assembly of claim 13, wherein said positioning pins are carried by said drive body.

15. The ratcheting assembly of claim 14, wherein said positioning pins are slidably movable relative to said drive body in response to movement of said pawls.

16. The ratcheting assembly of claim 15, wherein the ratchet head is coupled to an air driven tool handle.

17. The ratcheting assembly of claim 16, wherein said reversing assembly includes a pair of plungers and associated compression springs coupled to said knob and respectively engageable with said pawls for pivoting said pawls in response to movement of said reversing knob between said forward and reverse ratcheting conditions.

* * * * *